US006596956B1

(12) United States Patent
Czarnecki

(10) Patent No.: US 6,596,956 B1
(45) Date of Patent: Jul. 22, 2003

(54) SPDT SWITCH WITH MULTIPLE CONTACT ARRANGEMENT

(75) Inventor: Neil A. Czarnecki, Mt. Pleasant, WI (US)

(73) Assignee: Reliance Controls Corporation, Racine, WI (US)

( * ) Notice: Subject to any disclaimer, the term of this patent is extended or adjusted under 35 U.S.C. 154(b) by 0 days.

(21) Appl. No.: 10/006,846

(22) Filed: Nov. 5, 2001

(51) Int. Cl.[7] ..... H01H 21/80
(52) U.S. Cl. ..... 200/552; 200/558; 200/339
(58) Field of Search ..... 200/6 R, 6 B, 200/6 C, 405, 410, 416, 449, 452, 431, 437, 439, 553, 557, 558, 559, 560, 339

(56) References Cited

U.S. PATENT DOCUMENTS

| | | | | |
|---|---|---|---|---|
| 2,782,279 A | | 2/1957 | Heusser | 200/68 |
| 3,225,156 A | | 12/1965 | Sahrbacker | 200/67 G |
| 3,671,693 A | | 6/1972 | Farrell | 200/67 G |
| 4,168,416 A | | 9/1979 | Josemans | 200/323 |
| 4,408,105 A | * | 10/1983 | Tanaka | 200/437 |
| 4,789,766 A | * | 12/1988 | Krause | 200/302.3 |
| 4,814,554 A | | 3/1989 | Magiera | 200/6 R |
| 4,874,911 A | * | 10/1989 | Parrish | 200/6 R |
| 5,045,648 A | * | 9/1991 | Fogleman, Sr. | 200/43.16 |
| 5,105,059 A | | 4/1992 | Sorenson et al. | 200/302.3 |
| 5,436,421 A | * | 7/1995 | Sadowski | 200/558 |
| 5,660,270 A | * | 8/1997 | Martin et al. | 200/315 |
| 5,735,392 A | | 4/1998 | Shirasaka | 200/553 |
| 6,013,885 A | * | 1/2000 | Kowalczyk | 200/315 |
| 6,175,090 B1 | | 1/2001 | Blossfeld | 200/558 |
| 6,339,201 B1 | * | 1/2002 | Balaban et al. | 200/339 |

* cited by examiner

*Primary Examiner*—Michael Friedhofer
(74) *Attorney, Agent, or Firm*—Boyle, Fredrickson, Newholm, Stein & Gratz, S.C.

(57) ABSTRACT

An electrical switch includes a housing within which a stationary center contact arrangement is located. Spaced apart stationary first and second contacts are located on opposite sides of the center contact arrangement. A movable contact member is maintained in engagement with the center contact arrangement, and is selectively engageable with either the first stationary contacts or the second stationary contacts, in response to operation of an actuator mechanism associated with the housing. The movable contact member includes a unitary center contact area, in combination with a series of spaced apart first contact arms extending outwardly from the center contact area, and a series of spaced apart second contact arms extending outwardly from the center contact area. The first and second contact arms are selectively engageable with the stationary first and second contacts mounted to the housing, and the common center contact area ensures movement of the first and second contact arms in unison between respective first and second operative positions which establish connection with the respective first and second stationary contacts. The electrical switch is capable of being used as a transfer switch, for selectively supplying power to a single load from one of two power sources, each of which is interconnected with one of the sets of first and second stationary contacts.

23 Claims, 5 Drawing Sheets

SPDT SWITCH WITH MULTIPLE CONTACT ARRANGEMENT

BACKGROUND AND SUMMARY OF THE INVENTION

This invention relates to electrical switches, and more particularly to an electrical switch of the type having stationary spaced apart first and second contact areas and a stationary center contact area located therebetween, in combination with a movable contact member for selectively establishing an electrical path between the center contact area and either the first stationary contact area or the second stationary contact area.

Typical single-pole double-throw (SPDT) switches are used to alternately connect two different loads to a single power source. A typical SPDT switch includes a housing to which a generally U-shaped center contact saddle is mounted, in combination with spaced apart first and second contacts located on opposite sides of the center contact saddle. A movable contact, which is generally L-shaped or V-shaped, is engaged with the center contact saddle and is movable between a first operative position and a second operative position. In the first operative position, a movable contact carried by a first leg of the movable contact member is engaged with the first stationary contact, to establish an electrical path between the first stationary contact and the center contact saddle. In the second operative position, a movable contact carried by a second leg of the movable contact member is engaged with the second stationary contact, to establish an electrical path between the second stationary contact and the center contact saddle. A movable actuator is mounted to the housing for moving the movable contact member between the first and second operative positions, and to an inoperative position in which neither of the movable contacts is engaged with its respective stationary first or second contact.

Typically, it has been known to increase the number of stationary contacts and movable contact members in order to increase the current-carrying capacity of the switch, since increasing the size of the stationary contacts and/or the movable contact member does not in and of itself serve to increase current-carrying capacity. In the prior art, this results in a switch such as is illustrated in Krause U.S. Pat. No. 4,789,766 as well as various other prior art patents. Solutions of this type involve increasing the number of stationary first, second and center contacts, and providing an additional movable contact member for each additional set of stationary first, second and center contacts. The switch actuator includes a separate biased plunger member for each movable contact member, such that the movable contact members move in unison between the first and second operative positions in response to movement of the switch actuator. While this type of switch construction serves to increase current-carrying capacity, it involves certain drawbacks and also limits the applications in which this type of switch can be used. For example, this construction provides a one-to-one ratio between the number of stationary center contacts and the number of stationary first and second contacts. Further, this construction entails additional components, which provides a corresponding increase in the number of assembly steps and thereby the cost of manufacture of the switch. Most importantly, however, this construction creates the potential for the separate movable contact members to be in opposite operative positions. For example, in the event one of the contacts of one of the movable contact members becomes welded to one of the stationary contacts, or becomes jammed or otherwise stuck in one position, it is possible for the other of the movable contact members to be moved to the opposite operative position independently of the movable contact member that is prevented from movement. This can result in two loads being effectively connected to the single power source at the same time, which is typically undesirable in the circuit in which this type of switch is employed. Furthermore, this construction prevents a switch of this type from being used as a transfer switch, in which the switch is used to alternately connect a single load to either a first power supply or a second power supply. In an application such as this, it is essential that there can be no possibility for the load to be connected to both power supplies at the same time due to the relatively serious consequences which could result from such an occurrence.

It is an object of the present invention to provide an electrical switch which utilizes a similar overall construction and operation as prior art switches of the type described above, and which incorporates a feature that ensures the movable contact member cannot be in a position in which contact is simultaneously established between the center contacts and both the first and second stationary contacts on either side of the center contacts. It is a further object of the invention to provide such an electrical switch which is thus capable of being used as a transfer switch, to alternately connect a load with one of two available power sources. A still further object of the invention is to provide such an electrical switch which produces minimal arcing or bouncing of the movable contact member during movement between the first and second operative positions, to maintain full contact with the stationary center contact arrangement. A still further object of the invention is to provide such an electrical switch which ensures an equal distribution of current as the current flows through the movable contact member. A still further object of the invention is to provide such an electrical switch which is relatively simple in its components and construction, yet which functions in a highly satisfactory manner to either selectively connect one of two loads with a power source, or to act as a transfer switch that selectively connects a load with one of two power sources.

In accordance with the invention, an electrical switch includes a housing, and spaced apart sets of stationary first and second contacts are mounted to the housing. A stationary center contact arrangement is mounted to the housing, and is located between the sets of stationary first and second contacts. A movable contact member is contained within the housing, and an actuator is engaged with the movable contact member for moving the movable contact member between a first operative position in which the movable contact member establishes an electrical path between the stationary center contact arrangement and the set of stationary first contacts, and a second operative position in which the movable contact member establishes an electrical path between the stationary center contact arrangement and the set of stationary second contacts. The movable contact member includes a common central contact area which is engaged with the stationary center contact arrangement, in combination with a number of separate first arms that extend outwardly from the center contact area in a first direction, and a number of separate second arms that extend outwardly from the center contact area in a second direction opposite the first direction. The number of first and second arms corresponds to the number of stationary first and second contacts, respectively. With this construction, each of the first arms establishes an electrical path between the center contact arrangement and one of the stationary first contacts when the movable contact member is in the first operative position, and each of the second arms establishes an electrical path between the center contact arrangement and one of the stationary second contacts when the movable contact member is in the second operative position.

The center contact arrangement may be in the form of a series of spaced apart center contact members, and the center contact area of the movable contact member spans between and engages the spaced apart center contact members. In a preferred form, the center contact members define coplanar flat contact surfaces, and the center contact area of the movable contact member defines a rocking center contact construction which remains in engagement with the flat contact surfaces of the spaced apart center contacts during movement of the movable contact member between its first and second operative positions. The number of center contact members may be the same, greater or less than the number of stationary first and second contacts.

The movable contact member is preferably constructed such that the first and second sets of arms are formed integrally with the center contact area. The center contact area is preferably defined by intersecting first and second planar sections which cooperate to define a V-shape, and the point of intersection of the first and second sections forms a fulcrum that rests on the contact surfaces of the stationary center contact members. The set of first arms are preferably in the form of outward extensions of the first center contact section, and the set of second arms are preferably in the form of outward extensions of the second center contact section. The sets of first and second arms are preferably separated from each other by a gap or space located outwardly of an intermediate portion of the center contact area located between adjacent first arms and adjacent second arms.

Each of the first and second arms is flexible and resilient, and the actuator includes a separate actuating member that engages each of the first arms when the movable contact member is in the first operative position, and that engages each of the second arms when the movable contact member is in the second operative position. Each actuating member is preferably in the form of a biased plunger which exerts a force on the first arm of the movable center contact member when the movable contact member is in the first operative position, and on the second arm of the movable contact member when the movable contact member is in the second operative position. Each of the first and second arms is flexible and resilient, such that application of the force on each arm by the actuator member is operable to ensure proper fill contact of each arm with its respective stationary contact.

The center contact area provides a common connection of each of the first and second arms, to ensure proper current sharing when the movable contact member is in either the first operative position or the second operative position. In addition, the construction of the movable contact member, in which the arms extend from a common center contact area, ensures that it is impossible for the movable contact member to be in a position in which both the first and second contacts are electrically connected to the center contact arrangement at the same time, to enable the switch to be utilized as a transfer switch.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
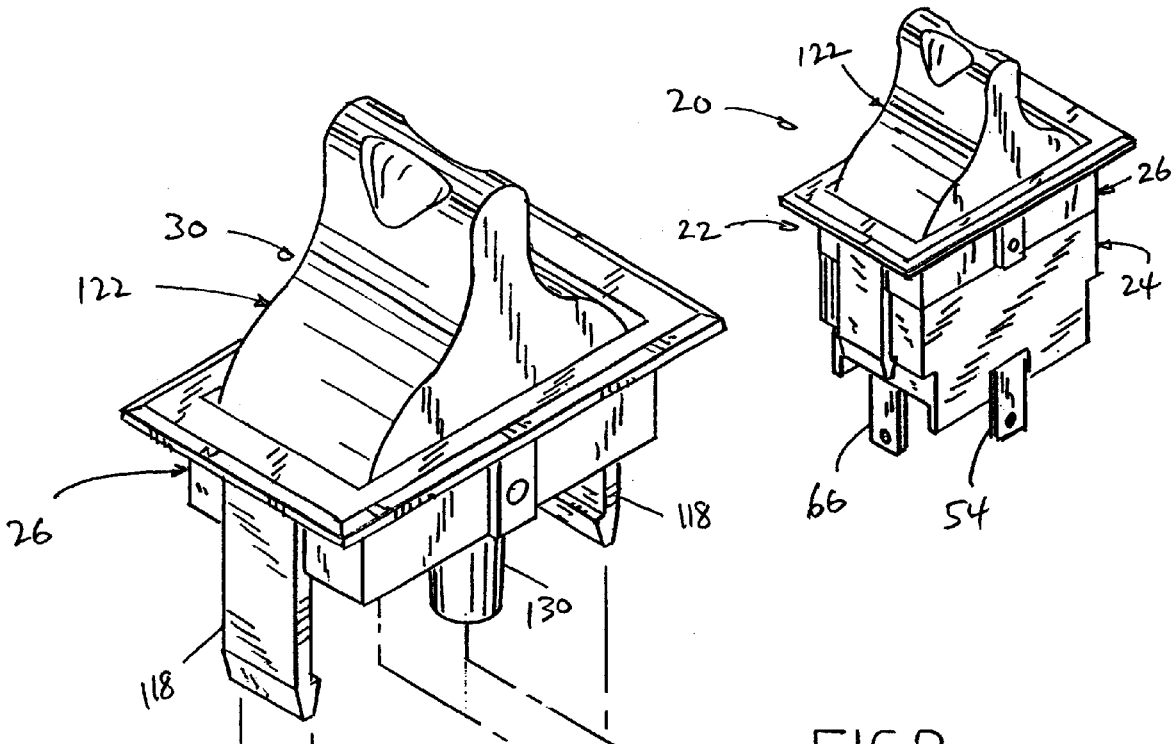
FIG. 1 is an isometric view of an assembled electrical switch constructed in accordance with the present invention.
Figure 2:
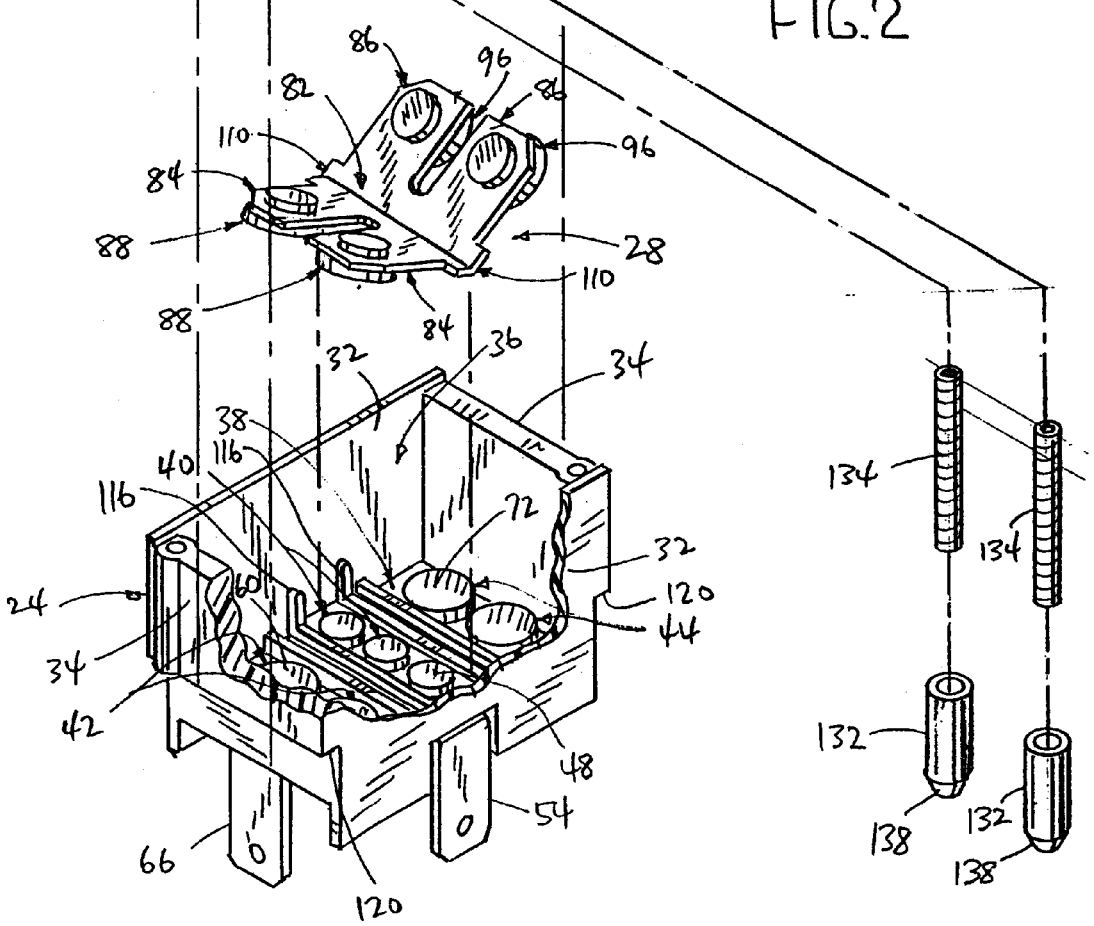
FIG. 2 is an exploded isometric view illustrating the components incorporated into the electrical switch of claim 1.

Referring to FIGS. 1 and 2, an electrical switch 20 generally includes a housing 20 made up of a base 24 and a cover 26, together with a movable contact member 28 positioned within the interior of housing 28, and an actuator 30 carried by cover 26 for controlling movement of movable contact member 28 relative to housing 22.

Figure 3:
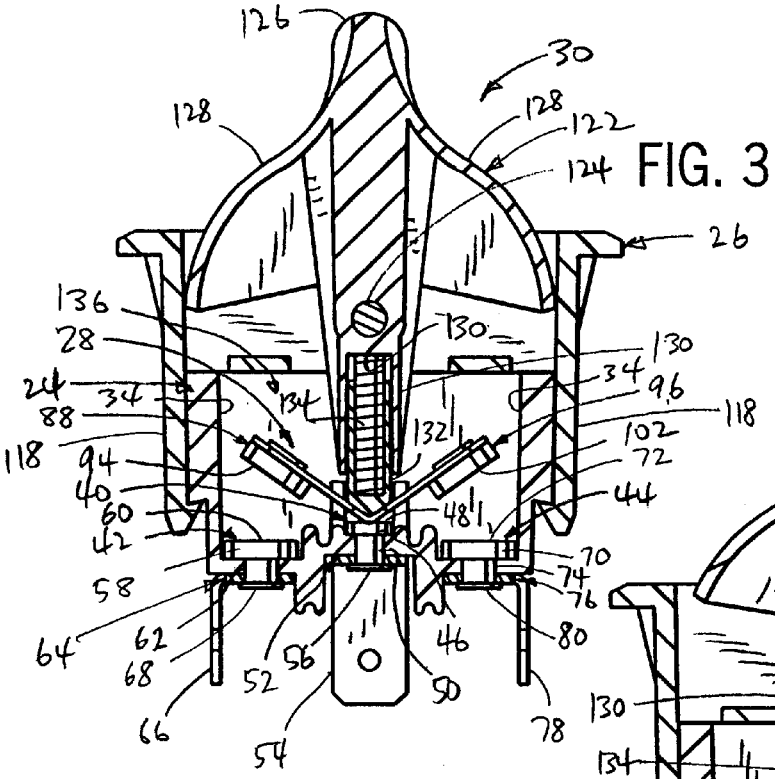
FIG. 3 is a sectional view through the electrical switch of claim 1, showing the movable contact member in an inoperative position.
Figure 6:
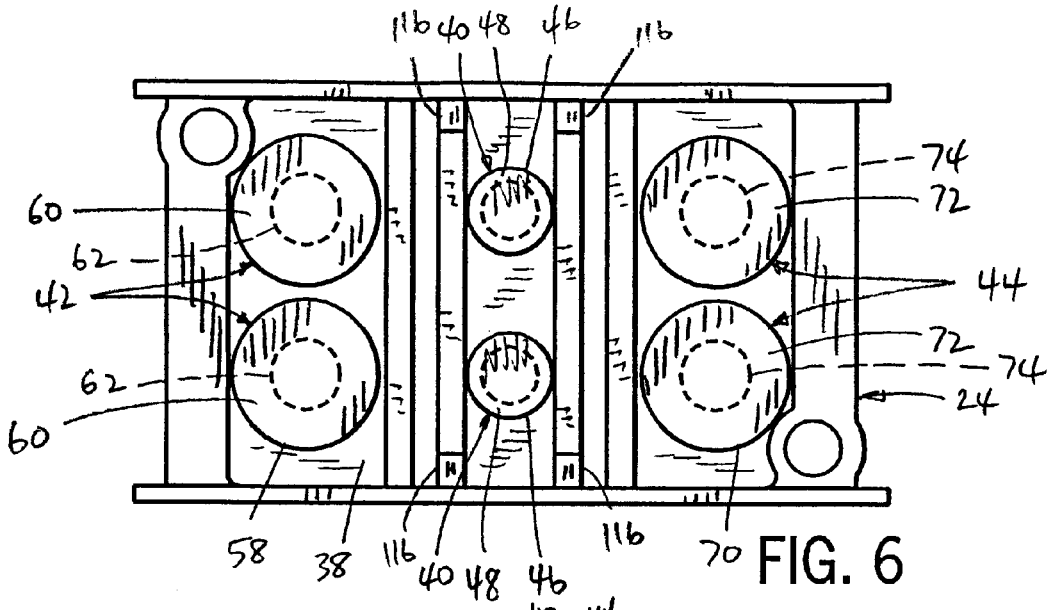
FIG. 6 is a plan view illustrating a portion of the housing and the stationary contact members, incorporated into the electrical switch of FIG. 1.

Referring to FIGS. 2, 3 and 6, housing base 24 includes a pair of side walls 32 and a pair of end walls 34, which cooperate to define an internal cavity 36 within which movable contact member 28 is received. Side walls 32 and end walls 34 extend upwardly from a bottom wall 38, which defines the lower extent of cavity 36.

A series of stationary contacts are secured to bottom wall 38 of housing base 24. The stationary contacts include a series of rivet-type center contacts 40, along with a series of rivet-type first contacts 42 and a series of rivet-type second contacts 44. Each center contact 40 includes a contact head 46 defining an upwardly facing contact surface 48, in combination with a shaft 50 that extends through an aperture formed in bottom wall 38 of housing base 24. Shaft 50 also extends through an aligned aperture formed in a terminal strip 52 in engagement with the underside of bottom wall 38, which includes a bent prong 54 in accordance with conventional construction. At the end opposite contact head 46, each center contact 40 includes a retainer head 56. In a known manner, each retainer head 56 functions to secure its respective center contact 40 to bottom wall 38 of housing base 24, and also to secure terminal strip 52 to bottom wall 38. In addition, retainer heads 46 function to establish an electrical connection between each center contact 40 and terminal strip 52. Bottom wall 38 and center contacts 40 are constructed and assembled such that upper contact surfaces 48 of center contact heads 46 lie in a common plane.

In a similar manner, each stationary first contact 42 includes a contact head 58 defining an upwardly facing contact surface 60, and a shaft 62 that extends through an opening in bottom wall 38 and an aligned aperture in a terminal strip 64 which includes a depending contact prong 66. A retainer head 68 is formed at the end of shaft 62 opposite contact head 58, for maintaining each first contact 42 and its associated retainer strip 64 in engagement with bottom wall 38 and to establish an electrical connection of each first contact 42 with retainer strip 64. Again, stationary first contacts 42 and bottom wall 38 are configured and arranged such that upper contact surfaces 60 of first contact heads 58 are coplanar.

In a similar manner, each second contact 44 includes a contact head 70 defining an upwardly facing contact surface 72, and a shaft 74 that extends through an opening in bottom wall 38 and an aligned aperture in a terminal strip 76 which includes a depending contact prong 78. A retainer head 80 is formed at the end of shaft 74 opposite contact head 70, for securing each second contact 44 and its associated terminal strip 76 to bottom wall 38, and to establish an electrical connection between each second contact 44 and terminal strip 76. Again, second contacts 44 and bottom wall 38 are configured and arranged such that upper contact surfaces 72 of each second contact 44 are coplanar. In the illustrated embodiment, upper contact surfaces 72 of second contacts 44 lie in the same plane as upper contact surfaces 60 of first contacts 42, which is located below the plane of upper contact surfaces 48 of center contacts 40.

FIG. 1 illustrates a pair of first contacts 42 and a pair of second contacts 44, located on opposite sides of a set of three center contacts 40. FIG. 6 illustrates a set of two center contacts 40. As will be understood, any number of center contacts 40 may be employed in electrical switch 20 constructed in accordance with the present invention, and the number may be greater than, less than or the same as the number of stationary first contacts 42 and second contacts 44.

Each stationary first contact 40 is located directly opposite one of second contacts 44, with center contacts 40 located therebetween. Each first contact 42 is aligned with its respective opposite second contact 44, such that a line which intersects the centers of each pair of first and second contacts are parallel to each other. In addition, the first contacts 42 and the second contacts 44 are aligned and parallel to a line connecting the centers of center contacts 40. First contacts 42 and second contacts 44 are spaced an equal distance from center contacts 40.

Figure 7:
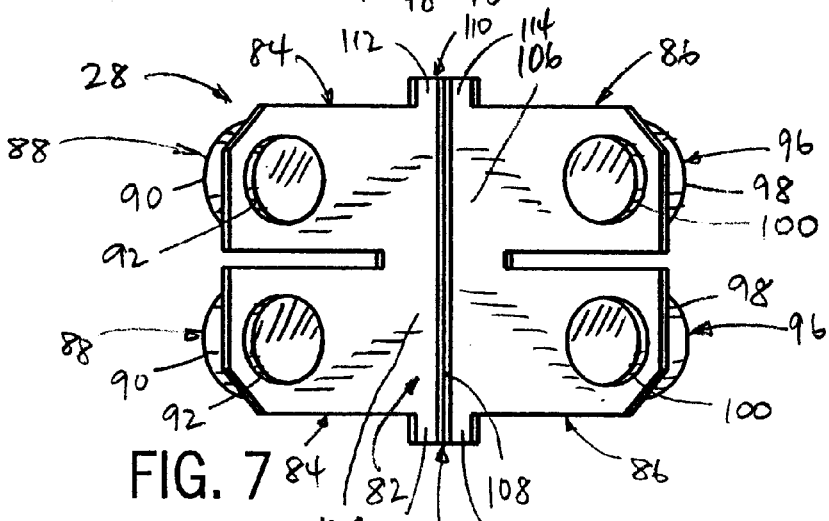
FIG. 7 is a plan view showing the movable contact member incorporated into the electrical switch of FIG. 1.
Figure 8:
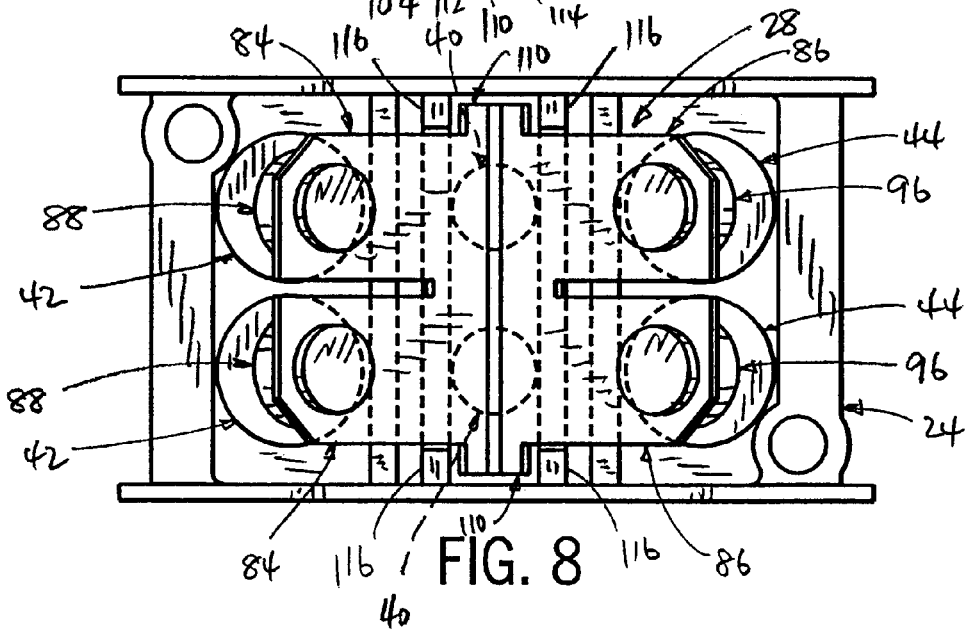
FIG. 8 is a plan view showing the movable contact member of FIG. 7 in position within the portion of the housing illustrated in FIG. 6, and the position of the movable contact member relative to the stationary contacts.

Referring to FIGS. 2, 3 and 7, movable contact member 28 includes a center contact area 82, a pair of spaced apart first contact arms 84 separated by a space 85 and extending outwardly from center contact area 82 in a first direction, and a pair of spaced apart second contact arms 86 separated by a space 87 extending outwardly from center contact area 82 in a second direction opposite the first direction. A rivet-type movable first contact 88 is connected toward the outer end of each first contact arm 84, including a contact head 90, a shaft that extends through an aperture formed in first contact arm 84, and a retainer head 92 that serves to secure each movable first contact 88 to its associated first contact arm 84 and to establish an electrical connection between movable first contact 88 and the first contact arm 84. Contact head 90 of each movable first contact 88 defines a downwardly facing movable contact surface 94.

Similarly, a movable second contact 96 is secured toward the outer end of each second contact arm 86. Each movable second contact 96 includes a contact head 98, a shaft extending through an aperture formed toward the outer end of each second contact arm 86, and a retainer head 100 on the opposite side of each second contact arm 86 for securing the movable second contact 96 to its associated second contact arm 86 and for establishing an electrical connection therebetween. Contact head 98 of each movable second contact 96 defines a downwardly facing movable contact surface 102.

Center contact area 82 of movable contact member 28 is in the form of a V-shaped member made up of a planar first wall 104 and a planar second wall 106, which intersect at a vertex 108. Center contact area 82 spans between center contacts 40, such that vertex 108 is engaged with upper contact surface 48 of each center contact 40.

A V-shaped retainer tab 110 extends outwardly from each side of movable contact member 28. Each tab 110 includes intersecting tab walls 112, 114, which are in the form of outward extensions of the inner portions of planar first and second walls 104, 106, respectively. When movable contact member 28 is positioned within cavity 36 of housing base 24, each tab 110 of movable contact member 28 is positioned between a pair of spaced apart retaining ridges 116 extending above upper contact surfaces 48 of center contacts 40, and extending inwardly from the inner surface of each base side wall 32.

First contact arms 84 of movable contact member 28 are coplanar with each other and with planar first wall 104 of central contact area 82. Similarly, second contact arms 86 are coplanar with each other and with planar second wall 106 of center contact area 82. First contact arms 84 and second contact arms 86 are formed integrally with center contact area 82, and are in the form of outward extensions of planar first and second walls 104, 106, respectively. With this construction, first and second contact arms 84, 86 are formed integrally with the material of center contact area 82, which is preferably formed of a conductive material, e.g. copper plated with fine silver.

Referring to FIGS. 2–3, housing cover 26 is engageable with the upper ends of housing base side walls 32 and end walls 34, and cooperates with actuator 30 to enclose internal cavity 36 defined by housing base 24. The general structure and assembly of base 24, cover 26 and actuator 30 are known in the art. In a manner as is known, cover 26 includes a pair of flexible retaining fingers 118, which are engageable with retaining surfaces 120 defined by housing base 24, so as to secure cover 26 to base 24.

Actuator 30 includes an actuator member 122 pivotably mounted between spaced apart side walls of cover 26 via a pivot pin 124. Actuator member 122 includes a manually engageable actuator tab 126, in combination with a pair of wings 128 extending downwardly and outwardly from actuator tab 126. In a known manner, wings 128 function to enclose the upper end of base internal cavity 36 when cover 26 and actuator 30 are mounted to base 24.

Actuator member 122 further includes a pair of barrel sections 130 located inwardly of pivot pin 124. An actuating plunger 132 is mounted for inward-outward movement within a passage defined by each barrel section 130, and a spring 134 is received within a passage defined by each plunger 132. Spring 134 bears against an end surface 136 defined by barrel section 130, so as to bias plunger 132 outwardly. Plunger 132 includes a generally conical outer end or tip 138, which engages moveable contact member 28 for providing movement of movable contact member 28 in response to pivoting movement of actuator member 122 about pivot pin 124.

In operation, electrical switch 20 functions as follows. It is understood that electrical switch 20 may be connected in a circuit in which power is supplied to center contacts 40 through terminal strip 52 and prong 54, for selective connection to one or the other of a pair of electrical loads interconnected with electrical switch 20 via first and second stationary contacts 42, 44 and their associated respective terminal strips 64, 76 and contact prongs 66, 78. Alternatively, electrical switch 20 may be used in a transfer switch application in which separate sources of power are connected to first and second stationary contacts 42, 44, and a single load is connected to center contacts 40.

To prevent connection between center contacts 40 and stationary first and second contacts 42, 44, respectively, electrical switch 20 is maintained in its inoperative position of FIG. 3, in which actuator member 122 is in an intermediate position and neither of movable first contacts 88 nor movable second contacts 98 are engaged with the respective underlying stationary first and second contacts 42, 44. Typically, a detent arrangement is interposed between cover 26 and actuator member 122 for maintaining movable contact member 28 in its inoperative position of FIG. 3. In this position, the conical tip 138 of each plunger 132 is engaged with center contact area 82, for forcing vertex 108 of movable contact member 28 against upper contact surfaces 48 of center contacts 40. Conical tip 138 is angled in a manner so as to correspond with the angle between planar first and second walls 104, 106, respectively, of center contact area 82, to prevent movement of movable contact member 28 when in its inoperative position.

Figure 4:
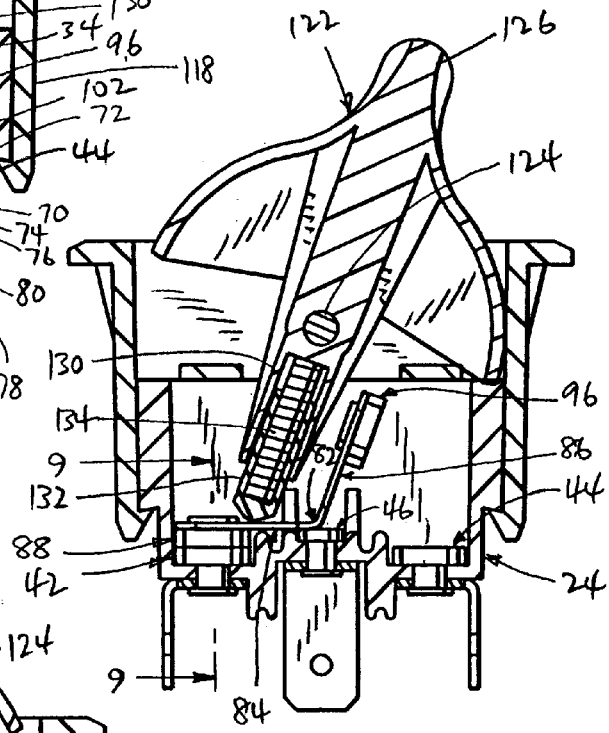
FIG. 4 is a view similar to FIG. 3, showing the movable contact member in a first operative position.

To establish contact between stationary center contacts 40 and stationary first contacts 42, actuator member 122 is pivoted in a clockwise direction about pivot pin 124 to the first operative position of FIG. 4. This functions to either interconnect a load associated with center contacts 40 with a power supply associated with first contacts 42, or to connect a power supply associated with center contacts 40 with a load associated with first contacts 42. Pivoting movement of actuator member 122 in this manner functions to slide plungers 132 outwardly from vertex 108 toward movable first contacts 88. Vertex 108 of movable contact member 28 acts as a fulcrum about which movable contact member 28 is pivoted in a counterclockwise fashion, to bring movable contact surfaces 94 of movable first contacts 88 into engagement with upper contact surfaces 60 of stationary first contacts 42. Barrel sections 130 and plungers 132 are oriented such that each spring 134 provides a primarily downward force on first contact arms 84, so as to urge movable first contacts 88 into engagement with stationary first contacts 42. Simultaneously, the downward force applied by each plunger 132 is operable to maintain the portion of planar first wall 104 adjacent vertex 108 in engagement with upper contact surface 48 of its respective center contact 40.

Figure 9:
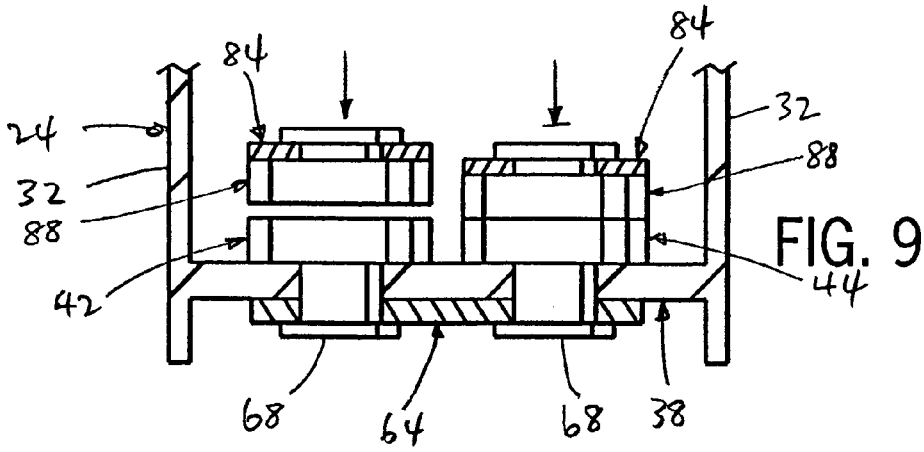
FIG. 9 is a partial section view taken along line 9—9 of FIG. 4.
Figure 10:
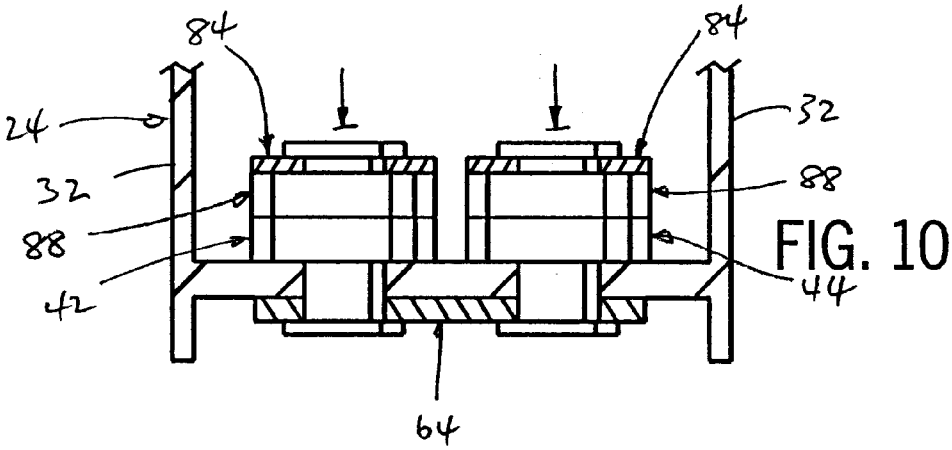
FIG. 10 is a partial section view similar to FIG. 9.

In this position, a plunger 132 is in engagement with each of first contact arms 84, which are flexible and resilient relative to center contact area 82 of movable contact member 28. The axial groove 85 between first contact arms 84 allows plungers 132 to flex first contact arms 84 different amounts as required to establish full contact with stationary first contacts 42. This feature is illustrated in FIGS. 9 and 10. As shown in FIG. 9, initial movement of movable contact member 28 may result in one of movable first contacts 88 being spaced slightly above its associated stationary first contact 42. Application of the biased downward forces exerted by plungers 132, however, functions to flex the first contact arm 84 downwardly so as to engage movable first contact 88 with stationary first contact 42, as shown in FIG. 10.

Figure 5:
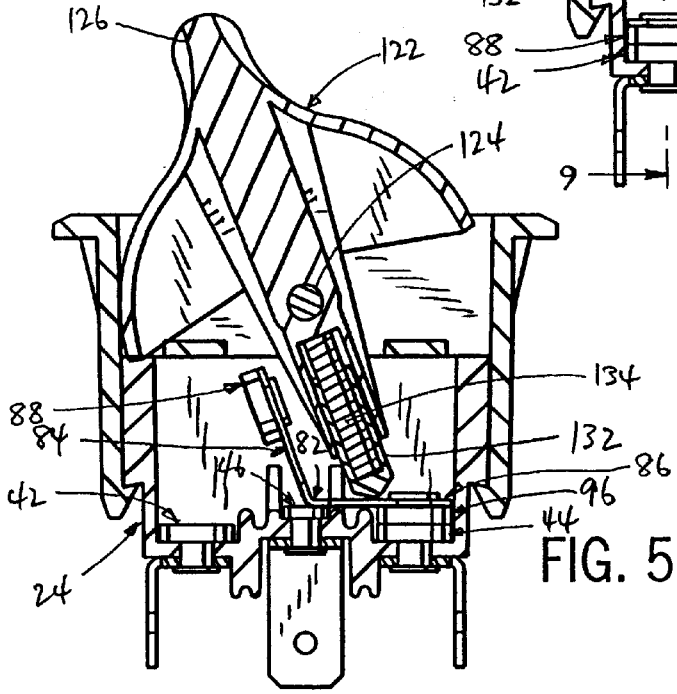
FIG. 5 is a view similar to FIGS. 3 and 4, showing the movable contact member in a second operative position.

To break the connection between center contacts 40 and stationary first contacts 42, the user moves actuator member 122 to the inoperative position of FIG. 3. To then establish a connection between center contacts 40 and stationary second contacts 44, the user pivots actuator member 122 in a counterclockwise direction to a position as shown in FIG. 5, which causes clockwise pivoting movement of movable contact member 28. In the same manner described previously, this results in the inner portion of planar second wall 106 of center contact area 82 moving into engagement with upper contact surfaces 48 of center contacts 40, and movement of movable second contacts 96 into engagement with stationary second contacts 44. In the same manner as described previously, space 87 between second contact arms 86 enables second contact arms 86 to flex relative to each other and relative to center contact area 82, to ensure proper engagement of movable second contacts 96 with stationary second contacts 84.

The configuration of movable contact member 28 and stationary center contacts 40 is such that movable contact member 28 moves smoothly between its various positions simply by "rocking" movement of vertex 108 on upper contact surfaces 48 of center contacts 40, while at all times maintaining full contact with upper contact surfaces 48. The flexibility of arms 84 and 86 ensures that the movable contacts are in full contact with the stationary contacts when the switch is placed in either of its operative positions. The provision of unitary center contact area 82 allows the movable contacts to share current load equally in two ways. First, the flexibility of the movable contact arms allows each of the movable contacts to seek its own seated position, so as to ensure proper contact. Further, the current load of the redundant contacts is shared at the common center area, to provide proper current sharing and to thereby optimize connection of the center contacts with the outer contacts.

Figure 11:
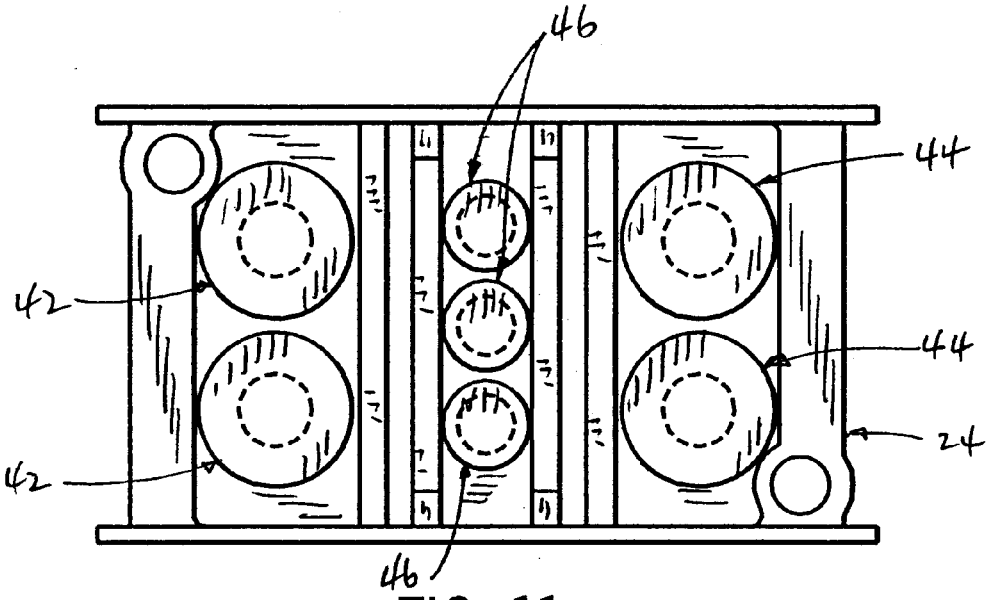
FIG. 11 is a view similar to FIG. 6, showing an alternative construction of the center contact arrangement.

FIG. 11 illustrates a disparity between the number of center contacts and the number of outer contacts. This arrangement is possible with the common center area of the movable contact member, which spans across and electrically connects any number of center contacts together. Because the contact-on-contact engagement of the movable contact member with the center contact members is an asperity contact, wherein current flows through only the first three points of any such contact, the number of contacts determines the minimum limit of the contact resistance and thus the maximum limit of the current-carrying capacity of the switch. By increasing the number of center contacts, as is possible using the movable contact member constructed according to the present invention, the maximum limit of the current-carrying capacity of the switch can be increased.

Figure 12:
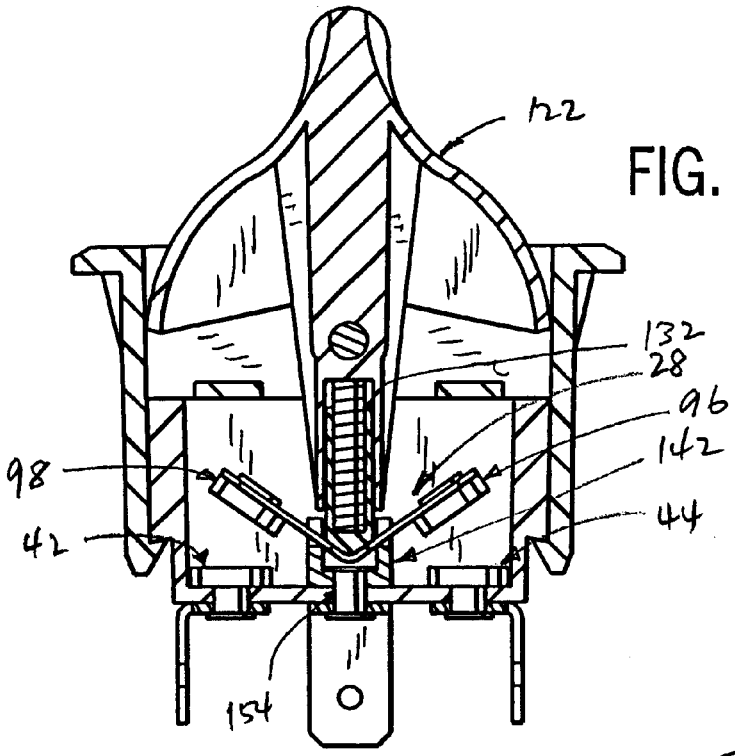
FIGS. 12 and 13 are section views similar to FIGS. 3 and 4, respectively, showing an alternative center contact member.
Figure 13:
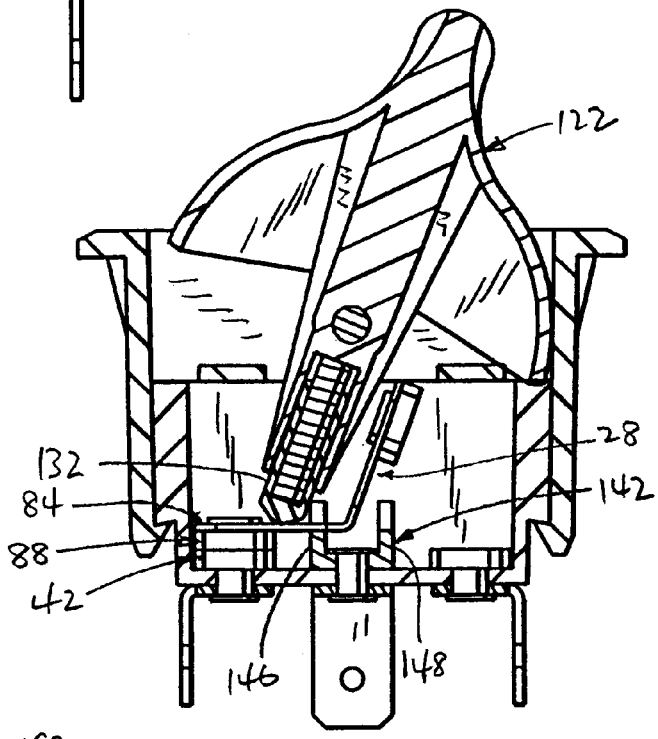
Figure 14:
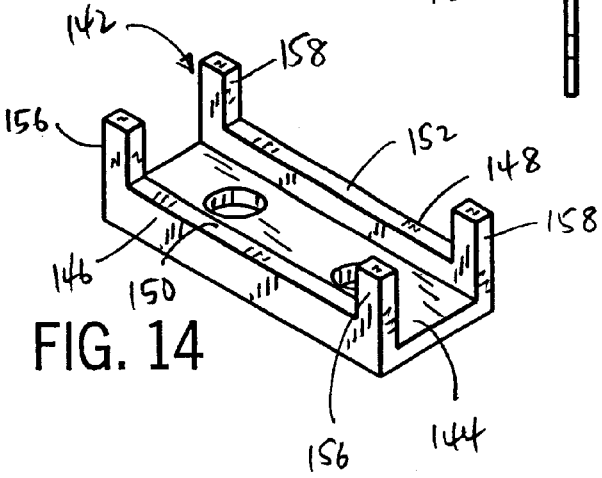
FIG. 14 is an isometric view of the center contact member incorporated in the electrical switch of FIGS. 12 and 13.

FIGS. 12–14 illustrate an alternative center contact arrangement, which is similar to a common type of center contact arrangement known in the art. In this version, a U-shaped center contact saddle 142 is employed in place of the individual center contacts 40 as illustrated in FIGS. 1–11. Center contact saddle 142 includes a bottom wall 144 and spaced apart upstanding side walls 146, 148, terminating in respective upper edges 150, 152. Rivets 154 extend through aligned openings in bottom wall 144 and terminal strip 52, and in a bottom wall of housing base 24. Side wall 146 includes a pair of upwardly extending legs 156 at its opposite ends, and side wall 148 includes a pair of upwardly extending legs 158 at its opposite ends.

Movable contact member 28 has the same construction as described previously, such that tabs 110 are positioned between the respective pairs of legs 156, 158 to maintain the position of movable contact member 28 within cavity 36 of housing base 24. When movable contact member 28 is moved to one of its operative positions, such as the first operative position as shown in FIG. 13, first contact arms 84 of movable contact member 28 remain in engagement with upper edge 150 of side wall 146, to establish electrical contact therewith. Again, the downward forces applied to first contact arms 84 by plungers 132 functions to seat movable first contact members 88 on stationary first contacts 42. In this case, the proper current load sharing is accomplished by the structure of center contact saddle 142.

The construction of movable contact member 28 enables electrical switch 10 to be employed as a transfer switch, since it is impossible for contact to be established between the stationary first and second contacts 42, 44. In the event one of the movable contacts were to become welded to one of the stationary contacts, the movable contact member cannot subsequently be moved to a position in which the non-welded contact can be brought into engagement with one of the opposite stationary contacts, due to the common connection of all of the movable contacts via the common center contact area. The strength of the material of movable contact member 28 is selected such that, in the event this were to occur, the biasing force applied by the associated plunger 132 is insufficient to flex the movable contact arm an amount sufficient to establish contact with the opposite stationary contact.

While the invention has been shown and described with respect to particular embodiments, it is understood that alternatives and modifications are possible and are contemplated as being within the scope of the present invention. For example, and without limitation, the spaced apart contact arms of the movable contact member are shown and described as being formed integrally with the material of the center contact area. It is also contemplated that the separate arms of the movable contact member may be formed separately and connected to the center contact area in any satisfactory manner. Further, the movable contact member has been shown and described as being formed of the material which itself is the conductor that establishes an electrical path between the center contact area and the movable contact members. It is also contemplated that the movable contact member may be formed of a resilient material, such as plastic, and that the movable contacts and the center contact area may be in the form of contact members electrically connected with each other and carried by the movable contact member. In addition, while a specific type of construction is shown for providing pivoting movement of the movable contact member relative to the housing, it is contemplated that any other type of pivot or rocking connection may be employed. In addition, while the invention has been described with respect to two pairs of contact arms which extend outwardly from the center contact area, it is understood that any number of contact arms on either side of the center contact area may be employed. The numbers of first and second contact arms may be equal or unequal, and the contact arms may be aligned with each other as shown or may be out of alignment with each other. Further, while a specific type of actuator has been shown and described, it is understood that any type of biased actuator which is capable of applying separate downward forces on the separate contact arms may be employed while still gaining the full advantages offered by the common center contact area and the spaced apart contact arms of the movable contact member of the present invention.

Various alternatives and embodiments are contemplated as being within the scope of the following claims particularly pointing out and distinctly claiming the subject matter regarded as the invention.

I claim:

1. An electrical switch, comprising:

a housing;

a plurality of first contacts stationarily mounted to the housing;

a plurality of second contacts stationarily mounted to the housing and spaced from the plurality of first contacts;

a stationary center contact arrangement mounted to the housing between the first and second stationary contacts;

a movable contact member mounted to the housing and movable between first and second engaged positions, wherein the movable contact member includes a center contact area and first and second arms extending outwardly from the center contact area, wherein the center contact area is engaged with the stationary center contact arrangement, and wherein each of the first and second arms comprises a plurality of separate arm sections extending outwardly from the center contact area, wherein each of the arm sections of the first arm includes a contact area adapted to engage one of the plurality of first stationary contacts when the movable contact member is in the first engaged position, and wherein each of the arm sections of the second arm includes a contact area adapted to engage one of the plurality of second stationary contacts when the movable contact member is in the second engaged position; and an actuator operably engaged with the movable contact member for moving the movable contact member between the first and second engaged positions.

2. The electrical switch of claim 1, wherein the stationary center contact arrangement comprises a pair of spaced apart center contacts, and wherein the center contact area of the movable contact member engages the spaced apart center contacts and spans therebetween.

3. The electrical switch of claim 2, wherein the housing and the center contact area of the movable contact member include a pivotable mounting arrangement for providing pivoting movement of the movable contact member between the first and second engaged positions.

4. The electrical switch of claim 3, wherein the pivotable mounting arrangement comprises a pair of laterally extending tabs, wherein each of the tabs extends outwardly relative to one of the spaced apart center contacts, and retainer structure associated with the housing for receiving the tabs therebetween.

5. The electrical switch of claim 2, wherein the arm sections of the first arm and the arm sections of the second arm are spaced apart from each other, and wherein the center contact area of the movable contact member extends across the space between the arm sections of each of the first and second arms.

6. The electrical switch of claim 5, wherein the center contact area of the movable contact member and the arm sections of each of the first and second arms are formed integrally with each other.

7. The electrical switch of claim 6, wherein the movable contact member comprises a unitary rocker member formed of a conductive material, and wherein the contact areas of the first and second arms comprise a plurality of contact members carried by the unitary rocker member.

8. The electrical switch of claim 7, wherein the center contact area of the movable contact member is in the form of a V-shaped member engaged with the spaced apart center contacts, and wherein the arm sections of the first and second arms extend outwardly in opposite directions from the V-shaped center contact area.

9. In an electrical switch including a plurality of stationary first contacts and a plurality of stationary second contacts spaced apart from each other and a center contact arrangement located therebetween, in combination with a movable contact member and an actuator operably engaged with the movable contact member for moving the movable contact member between first and second engaged positions, the improvement wherein the movable contact member comprises:

a center contact area engaged with the stationary center contact arrangement;

a plurality of separate first arm members extending outwardly from the center contact area in a first direction, wherein each of the first arm second members includes a contact area for engaging one of the plurality of stationary first contacts when the movable contact member is in the first engaged position; and a plurality of separate second arm members extending outwardly from the center contact area in a second direction opposite the first direction, wherein each of the second arm members includes a contact area for engaging one of the plurality of stationary second contacts when the movable contact member is in the second engaged position.

10. The improvement of claim 9, wherein the center contact arrangement comprises at least a pair of spaced apart center contacts, and wherein the center contact area of the movable contact member spans between and engages the pair of spaced apart center contacts.

11. The improvement of claim 10, wherein the plurality of separate first arm members and the plurality of separate second arm members, which extend outwardly from the center contact area, are formed integrally with the center contact area.

12. The improvement of claim 11, wherein the center contact area comprises first and second intersecting planar center contact sections, wherein the first arm members comprise outward extensions of the first planar center contact section and the second arm members comprise outward extensions of the second planar center contact section.

13. The improvement of claim 12, wherein the first arm members and the second arm members are coplanar with the first and second planar center contact sections, respectively.

14. The improvement of claim 11, wherein the actuator comprises a movable actuator body and a plurality of biased plunger members, wherein each of the plunger members is engageable with the center contact area and with a separate one of the first arm members to position the movable contact member in the first engaged position, and with a separate one of the second arms members to position the movable contact member in the second engaged position.

15. The improvement of claim 9, further comprising a retainer arrangement interposed between the movable contact member and a housing defined by the electrical switch, wherein the retainer arrangement is operable to maintain the center contact area of the movable contact member in engagement with the center contact arrangement during movement of the movable contact member between the first and second engaged positions.

16. The improvement of claim 15, wherein the first and second arm members are formed integrally with the center contact area of the movable contact member, and wherein the retainer arrangement comprises a pair of retainer tabs extending outwardly from opposite ends defined by the center contact area, in combination with spaced apart pairs of ribs defined by the housing, wherein each of the retainer tabs is located between one of the pairs of ribs, wherein the retainer tabs and the pairs of ribs cooperate to control movement of the movable contact member between the first and second engaged positions and to maintain the center contact area of the movable contact member in engagement with the center contact arrangement.

17. An electrical switch, comprising:

a housing;

a plurality of stationary first contacts mounted to the housing;

a plurality of stationary second contacts mounted to the housing and spaced from the stationary first contacts;

a stationary center contact arrangement mounted to the housing and located between the stationary first and second contacts;

a movable contact member comprising a center contact area engaged with the stationary center contact arrangement, a plurality of first arms interconnected with the center contact area and extending outwardly therefrom, wherein each of the first arms includes a contact adapted to engage one of the plurality of stationary first contacts when the movable contact member is in a first position, and a plurality of second arms interconnected with the center contact area and extending outwardly therefrom, wherein each of the second arms includes a contact adapted to engage one of the plurality of stationary second contacts when the movable contact member is in a second position; and an actuator interconnected with the housing and engageable with the movable contact member, wherein the actuator is operable to move the movable contact member between the first and second positions.

18. The electrical switch of claim 17, wherein the plurality of first arms and the plurality of second arms are formed integrally with the center contact area.

19. The electrical switch of claim 18, wherein the center contact comprises intersecting first and second planar sections, wherein the plurality of first arms comprise spaced apart outward extensions of the first planar section and wherein the plurality of second arms comprise spaced apart outward extensions of the second planar section.

20. The electrical switch of claim 18, wherein the center contact arrangement comprises a plurality of spaced apart center contact members, wherein the center contact area extends between and engages the plurality of center contact members.

21. The electrical switch of claim 18, wherein the actuator is engageable with the movable contact member via a plurality of biased plunger members, wherein each of the plunger members is movable into engagement with one of the first arms to place the movable contact member in the first position, and is movable into engagement with one of the second arms to place the movable contact member in the second position.

22. The electrical switch of claim 18, wherein the movable contact member and the housing define cooperating engagement structure for maintaining the movable contact member in a predetermined position relative to the housing during movement of the movable contact member between the first and second positions.

23. The electrical switch of claim 22, wherein the cooperating engagement structure comprises a pair of tabs formed integrally with the center contact area and extending outwardly in opposite directions from opposed side areas defined by the movable contact member, and opposed pairs of spaced apart protrusions defined by the housing, wherein each of the tabs is adapted to be received between one of the pairs of spaced apart protrusions, wherein engagement of the tabs between the pairs of spaced apart protrusions functions to maintain the position of the movable contact member relative to the housing during movement of the movable contact member between the first and second positions.

* * * * *